US006267845B1

(12) United States Patent
Hautala et al.

(10) Patent No.: US 6,267,845 B1
(45) Date of Patent: Jul. 31, 2001

(54) PROCESS ARRANGEMENT FOR THE SHORT CIRCULATION IN A PAPER OR BOARD MACHINE

(75) Inventors: Jouko Hautala; Timo Pekkarinen, both of Tampere; Antti Suonperä, Jyväskylä; Juha Kinnunen, Jyväskylä; Mari Silanterä, Jyväskylä; Lauri Verkasalo, Jyväskylä, all of (FI)

(73) Assignee: Valmet Corporation (FI)

( * ) Notice: Subject to any disclaimer, the term of this patent is extended or adjusted under 35 U.S.C. 154(b) by 0 days.

(21) Appl. No.: 09/329,770

(22) Filed: Jun. 10, 1999

(30) Foreign Application Priority Data

Jun. 10, 1998 (FI) ..... 981327

(51) Int. Cl.[7] ..... D21F 11/00

(52) U.S. Cl. ..... 162/183; 162/141; 162/202; 162/298; 162/289; 162/301; 162/336; 162/380; 162/381; 162/264; 162/190; 162/DIG. 11

(58) Field of Search ..... 162/183, 141, 162/202, 298, 289, 301, 336, 380, 381, 264, 190, DIG. 11

(56) References Cited

U.S. PATENT DOCUMENTS 4,889,594 * 12/1989 Gavelin ..... 162/130
5,868,905 * 2/1999 Graf ..... 162/320

FOREIGN PATENT DOCUMENTS 93132 8/1989 (FI) ..... D21F/11/04
81965 6/1990 (FI) ..... B01D/33/04
88415 1/1993 (FI) ..... D21F/1/66
9323135 11/1993 (WO) .
9323612 11/1993 (WO) .
9727359 7/1997 (WO) .

* cited by examiner

*Primary Examiner*—Peter Chin
*Assistant Examiner*—Mark Halpern
(74) *Attorney, Agent, or Firm*—Steinberg & Raskin, P.C.

(57) ABSTRACT

A process arrangement for the short circulation in a paper or board machine including stock chests for component stocks, metering pumps for component stocks, cleaning devices, pumps, a headbox and a wire section as well as a system of pipes connecting these elements, together with regulation devices. After the metering pumps, the component stock flows are passed into a closed mixing volume in which the component stocks are mixed and diluted with a first dilution water flow. From this closed mixing volume, the stock is passed in a closed space by a first feed pump of the main line of the process through a screen and a centrifugal cleaner to the suction side of a second feed pump of the main line, where a second dilution water flow is passed to the stock. The second feed pump feeds the stock through a machine screen to the inlet header in the headbox.

31 Claims, 7 Drawing Sheets

PROCESS ARRANGEMENT FOR THE SHORT CIRCULATION IN A PAPER OR BOARD MACHINE

FIELD OF THE INVENTION

The present invention relates to a process arrangement for the short circulation in a paper or board machine including stock chests for component stocks, metering pumps for component stocks, cleaning devices, pumps, a headbox and a wire section as well as a system of pipes connecting these apparatuses, together with regulation devices.

BACKGROUND OF THE INVENTION

Regarding its principal features, the stock feed at a paper machine is generally as follows. The stock components are stored at the paper mill in separate storage towers. From the storage towers, the stocks are fed into stock chests, and from the stock chests further into a common blend chest, in which the stock components are mixed with each other. From the blend chest, the stock is fed into a machine chest, and from the machine chest, there is an overflow back into the blend chest. From the machine chest, the stock, which is usually at a consistency of about 3%, is fed into a wire pit placed in the short circulation. In the wire pit, the high-consistency stock is diluted to a headbox consistency, which is usually about 1%.

The fibers and fillers which are used as the raw-material are passed onto a wire through the headbox while carried by water. The filtrate that has passed through the wire, which filtrate contains an abundance of fibrous material and fillers, is returned, as a diluting agent for the high-consistency stock coming from the machine chest, through the headbox back onto the wire. The flow loop thus formed is called the short circulation. The short circulation, together with the headbox connected with it, is commonly considered to be the most sensitive part of the papermaking process. Even little changes in the consistency, in the flow, or in other parameters have an immediate effect on the quality of the paper produced or cause web breaks in the paper machine.

Along with the high-consistency stock or along other paths, impurities may enter into the short circulation, which impurities must be removed before the headbox. This takes place by means of cleaning devices of the short circulation, which are, for example, centrifugal cleaners, screens and machine screens.

Ever stricter requirements of protection of the environment have resulted, in connection with paper and board machines, in more closed systems and also in a more closed short circulation and in as efficient recycling of raw-materials as possible. On the other hand, improved efficiency of production and minimizing of disturbance in the production are also aimed at. For this reason, among other things, a higher level of wire retention is used, which requires an increased use of retention agents.

The short circulations used in the present-day paper and board machines are rather complex, and the main line of the process includes an abundance of equipment, in which case, the process space required by the devices must be large. One reason for the complex nature of the short circulation of a paper or board machine is the binding of air in the circulation water in an open wire section. In order to remove the air from the water, it is necessary to construct one or even several deaeration systems. Air is bound in water in the wire section because the process portion after the wire is open and the circulation water is in direct contact with the surrounding air. Air is present in the circulation water both as air bubbles and in dissolved form. When the stock that is used for manufacture of paper is diluted with circulation water that contains air, the content of air in the water produces disturbance of many sorts in the formation of the paper web. Among other things, the content of air lowers the capacity, deteriorates the quality of the paper, and causes contamination of the process, formation of slime, blocking of cleaning devices, and wear.

Predicting vibrations in a system of short circulation is substantially more difficult than predicting purely mechanical vibrations. This results, among other things, from the fact that the coefficient of elasticity of flowing liquid also depends, to a great extent, on the air contained in the liquid. Also, the rigidity of the pipe systems and of the chests or tanks affects the rigidity of the system and, thus, the natural frequencies. Further, the velocity of progress of a pressure pulse in the stock slurry is slowed down substantially in compliance with the amount of undissolved air. Resilience of the walls in the pipe systems also has an effect slowing down the velocity of a pressure pulse. The variations arising from these factors have direct effects on the quality of the paper and are noticed as defects in the final product. Changes in the content of air in the stock also cause faults in the flow rate in the headbox. For example, air worsens the vibrations of the short circulation in the way mentioned above. Also, the air affects the density of the liquid to be pumped, and thereby it affects the pressure produced by a pump, and further it affects the basis weight.

For removal of air from the circulation water, a number of complex solutions are known in the prior art, which solutions involve additional devices and combinations of additional devices which result in additional costs of investment and operation, such as deaeration equipments, pumps, and chests or tanks. It is partly for this reason that the process volume of the main line becomes relatively large, as a result of which changes of paper grade in a paper machine require a long grade change time. Further, in the prior art processes, blend chests and stilling tanks have been used in order to keep the process conditions as invariable as possible.

In the current assignee's Finnish Laid-Open Publication No. 88,415, a process arrangement is described for production of headbox stock for a paper machine in the short circulation. In this arrangement, no fresh stock is mixed with the circulation water passing to the deaeration tank. In order to achieve this, in the arrangement, a combination wire pit is employed, which has been divided into two compartments or into two jointly operative tanks. The first tank is arranged as a feed tank for deaeration, and the second tank is arranged as a dilution tank for headbox stock, into which latter tank the fresh stock is fed. By means of this process arrangement, the principal objective has been to eliminate the essential problems produced by variations in consistency and by variations in pressure in the headbox.

On the other hand, in Finnish Laid-Open Publication No. 93,132 (in the name of Oy Tampella Ab), an integrated headbox and former arrangement is described, in which the stock is not in contact with the surrounding air as it is transferred from the headbox to the former. Also, the gap former used in the arrangement is closed, so that the stock and the white water cannot contact with the surrounding air. The draining of water in the former takes place by means of water drain boxes. For this integrated headbox-former unit, the designation CFF unit (Control Flow Former) is used.

In Finnish Laid-Open Publication No. 81,965 (also in the name of Oy Tampella Ab), a gap former is described in which the wires are supported on deck elements of closed box-like water drain spaces. The deck elements in the water drain space at the side of one of the wires are loaded resiliently against the wire in the desired way. Thus, in this former, pressure is used as an aid for the draining of the web, in which manner it is possible to enhance the separation of the solid matter from the suspension.

OBJECTS AND SUMMARY OF THE INVENTION

Accordingly, it is an object of the present invention to provide a simplified short circulation suitable for a paper or board machine, by means of which simplified short circulation it is possible to solve or at least substantially to reduce the problems related to the prior art.

It is a further object of the present invention to be able at least to reduce the binding of air in water in the short circulation of a paper or board machine to a substantial extent, as compared with the prior art.

In order to attain these objects and others, a process arrangement for the short circulation in a paper or board machine in accordance with the invention includes a headbox having at least one inlet header, a plurality of stock chests, each receiving a component stock, means defining a closed space, e.g., a main line of the process arrangement, metering pumps and optional screens and cleaning devices. Each metering pump is associated with a respective stock chest for pumping the component stock therefrom into the closed space. Dilution water, e.g., white water recovered from the wire section of the paper or board machine, is directed into the closed space whereby the component stocks and dilution water are mixed in the closed space. One or more feed pumps pump the mixed component stocks and dilution water through an enclosed environment from the closed space into a respective inlet header of the headbox. If more than one inlet header is present, the process arrangement could include a plurality of feed pumps, each arranged to pump at least a portion of the mixed component stocks and first flow of dilution water from the closed space into a respective inlet header.

In some embodiments, a deaeration tank is provided for receiving white water recovered from the wire section and is situated in an upper position relative to the closed space such that white water is passed from the deaeration tank by means of ram pressure into the closed space to thereby constitute the dilution water. The deaeration tank is arranged such that tank air is removed from the white water by means of a vacuum. In the alternative, the deaeration tank may be situated in a lower position relative to the wire section such that white water recovered from the wire section is passed by means of ram pressure into the deaeration tank. In this case, a circulation water pump pumps white water from the deaeration tank into the closed space which thereby constitutes the dilution water. In yet another alternative embodiment, there is no deaeration tank and a circulation water pump pumps white water recovered from the wire section directly from the wire section into the closed space which thereby constitutes the dilution water.

A dilution water pump may be provided for pumping white water recovered from the wire section into the inlet header(s) of the headbox and a dilution water screen is then interposed between the dilution water pump and the inlet header(s) of the headbox for screening the white water.

In the process arrangement in accordance with the invention, for precise regulation of the basis weight, the following properties have been found:

- the dilution of the component stocks to the metering consistency takes place before the stock chests of the component stocks,
- the regulation of the basis weight takes place from the stock chests of the component stocks by means of regulation of the flows of the component stocks, and
- the dilution to the headbox consistency takes place in two stages, of which the first one has an invariable flow, and in the second stage the flow is regulated by means of a control signal received from the headbox pressure regulation.

With respect to the regulation of the basis weight related to the process arrangement in accordance with the present invention, reference is made to the current assignee's Finnish Patent Application No. 981329.

With respect to the metering of a component stock related to the process arrangement in accordance with the present invention, reference is made to the current assignee's Finnish Patent Application No. 981328.

In an arrangement in accordance with the present invention, the main process line of the short circulation is closed. In one embodiment of the invention, the headbox and the former are also closed, in which case no air can be mixed with the white water in the wire section. In this embodiment, the circulation water departing from the wire section is kept in a closed space as slightly pressurized, in which case, it is possible to prevent binding of air in the white water. The white water needed for dilution of stocks is pumped along closed pipes to the dilution sites, where the dilution takes place in a closed space. For mixing of stock and water, pumps, stock cleaning devices, screens, and centrifugal cleaners normally needed in the process are used. Any excess water is removed from the short circulation as overflow from between the wire section and the circulation water pump or the deaeration tank to atmospheric pressure. From the stock cleaning devices, the rejects are removed for possible further treatment.

The process arrangement in accordance with the invention for the short circulation can be applied both in a paper machine and in a board machine. In a board machine, it is possible to use a number of parallel process arrangements in accordance with the invention for the short circulation at the same time.

By means of an arrangement in accordance with the invention, mixing of air with the white water can be minimized, in which case, the losses of fiber in the process are also minimized. The equipment is simple, and fewer components are needed than in the prior art systems. For these reasons, as compared with the prior art arrangements, the equipment in accordance with the invention is less expensive both in respect of the cost of acquisition and in respect of the servicing costs. The process arrangement also requires clearly less space, and it requires less spare parts than the prior art arrangements. Further, a change of paper grade is very rapid because the basis weight of paper can be regulated very quickly. The quality of the paper produced is uniform, because disturbance arising from variations in the content of air is avoided. Further, a considerably smaller amount of broke paper is produced in connection with change of paper grade, as compared with the prior art arrangements.

In the process arrangement in accordance with the present invention, in the main line, blend chests and a machine chests and related pumps etc., auxiliary devices are not needed. Further, in the system, there is no wire pit, for which reason, the overall volume of water in the short circulation can be made smaller. This again improves the level of hygiene of the water, because the dwell of the water and the fiber in the process is shorter than in the prior art, whereby microbiological contamination of the water is reduced. For this reason, it is possible to reduce the use of auxiliary chemicals, such as slime inhibiting agents, which results in economies in the costs of operation.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE PREFERRED EMBODIMENTS

Figure 1A:
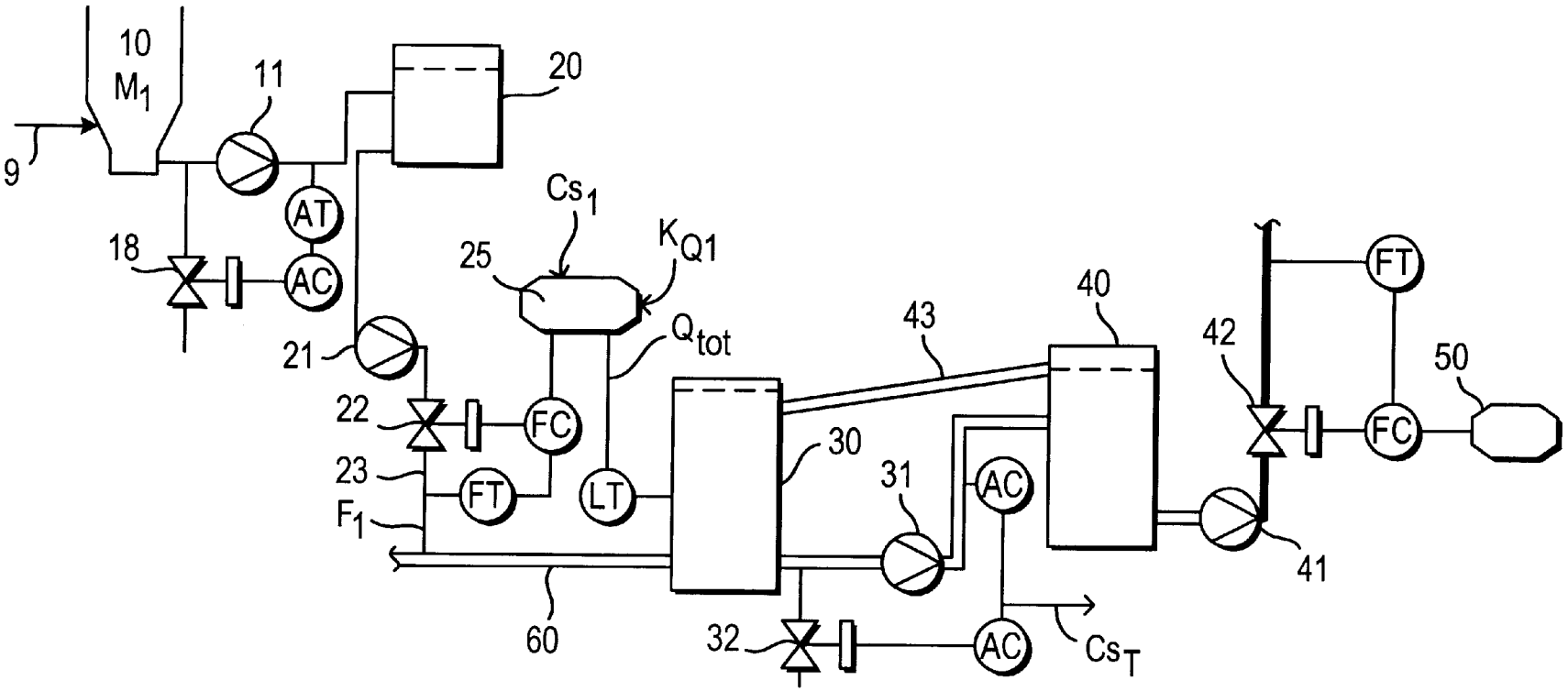
FIG. 1A PRIOR ART
FIG. 1A is a schematic illustration of a conventional prior art process arrangement of the stock feed in a paper machine.

Referring to FIGS. 1A–6 wherein like reference numerals refer to the same or similar elements, FIG. 1A is a schematic illustration of a conventional prior art process arrangement of the stock feed in a paper machine. Only one component stock is shown in FIG. 1A and the recovery of fibers, the regulation of the flow of the component stock, or the regulation of the surface level in the stock chest of the component stock have not been illustrated.

In FIG. 1A, a component stock $M_1$ is fed from a storage tower 10 by means of a first pump 11 into a stock chest 20. To the component stock, a dilution water flow is passed through a regulation valve 18 into connection with a first pump 11. Further, the component stock is diluted in the bottom portion of the storage tower 10 by means of a dilution water flow 9 passed to the bottom portion. From the stock chest 20, the component stock $M_1$ is fed by means of a second pump 21 through a regulation valve 22 and through a feed pipe 23 to a main line 60 of the process, which passes into a blend chest 30. From the blend chest 30 the stock is fed by means of a third pump 31 into a machine chest 40. From the machine chest 40, the machine stock $M_T$ is fed by means of a fourth pump 41, through a second regulation valve 42, into the short circulation. Moreover, from the machine chest 40, there is an overflow 43 passing back to the blend chest 30. The blend chest 30 and the machine chest 40 form a stock equalizing unit, and in them the stock is diluted to the ultimate metering consistency. Further, by their means, uniform metering of the machine stock is enabled.

The metering of the component stocks $M_i$ into the blend chest 30 takes place so that attempts are made constantly to keep a substantially constant surface level in the blend chest 30. Based on changes in the surface level in the blend chest 30, which changes are measured by a surface level detector LT, the surface level controller computes the total requirement $Q_{tot}$ of stock to be metered, which information is fed to the component stock metering-control block 25. Also, a pre-determined stock proportion value $K_{Qi}$ of the component stock $M_i$ and a consistency value $Cs_i$ of the component stock $M_i$ are fed to the metering-control block 25.

Based on the total requirement $Q_{tot}$ of stock $M_T$ and on the pre-determined proportions $K_{Qi}$ of component stocks, the metering-control block 25 computes the requirement $Q_i$ of feed of component stock. Based on the component stock feed requirement $Q_i$ and on the data $Cs_i$ on the consistency of the component stock $M_i$, the component stock metering-control block 25 computes the flow target $F_i$ of the component stock $M_1$. Based on this flow target $F_i$, the regulation valve 22 is controlled so as to produce the flow $F_i$ into the blend chest 30. The flow $F_i$ of the component stock $M_i$ is also measured constantly by means of a flow detector FT, whose measurement signal is fed through the flow controller FC to the component stock control valve 22.

From the blend chest 30, the stock is fed at a substantially constant flow velocity by means of the third pump 31 into the machine chest 40. At this pumping stage, the consistency of the stock is also regulated to the desired target consistency of the machine chest. This is accomplished by means of dilution water, which is fed through the regulation valve 32 to the outlet of the blend chest 30 to the suction side of the third pump 31. By means of the dilution water, the stock present in the blend chest 30, which is typically at a consistency of about 3.2%, is diluted to the ultimate metering consistency of about 3%. To the dilution water regulation valve 32, the metering signal of a consistency detector AT is directed, which detector AT has been connected to the pressure side of the pump 31. The measurement signal $Cs_T$ of the consistency detector AT, measured either after the third pump 31 or after the fourth pump 41, is passed to a basis weight controller 50.

The regulation of the basis weight takes place so that the basis weight controller 50 controls the regulation valve 42 placed after the fourth pump 41. By means of this regulation valve 42, the flow of the stock to be fed into the short circulation is regulated, which flow affects the basis weight of the paper web obtained from the paper machine. When the flow is increased, the basis weight becomes higher, and when the flow is reduced, the basis weight becomes lower.

Figure 1B:
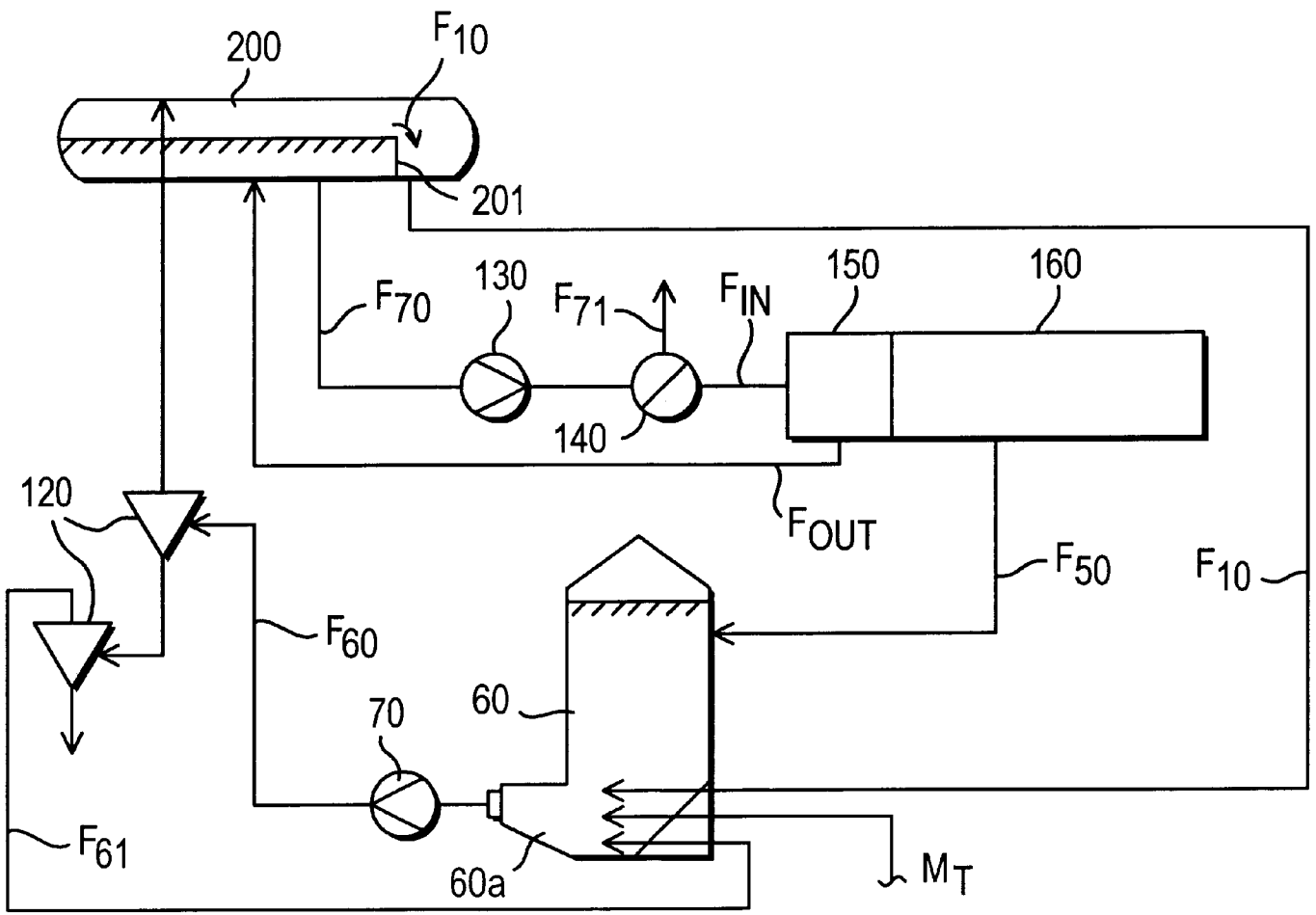
FIG. 1B PRIOR ART
FIG. 1B is a schematic illustration of a conventional prior art process arrangement of the short circulation in a paper machine.

FIG. 1B illustrates a conventional prior art short circulation in a paper machine. The stock flow $M_T$ passing into the wire pit 60 and shown in FIG. 1B is fed by means of the fourth pump 41 shown in FIG. 1A.

Headbox 150 feeds the stock suspension jet through its slice opening into the wire section 160. In the wire section 160, there are water collecting means, which pass the water drained through the wire, as a flow $F_{50}$, into the wire pit 60. To a mixing area 60*a* in the wire pit 60, a fresh stock flow $M_T$ is fed, whose consistency is typically of an order of about 3%. In the wire pit 60, the fresh stock is diluted to the headbox consistency, which is of an order of about 1%. To the mixing area 60*a* of the wire pit 60, the suction side of a first mixing and feed pump 70 has been connected. From the pressure side of the first pump 70, the stock flow $F_{60}$, which has been diluted to the headbox consistency, is passed through centrifugal cleaners 120 into a deaeration tank 200.

In the deaeration tank 200, there is an air space subjected to a vacuum above the free surface of the stock. The stock surface level is determined by an overflow 201 of the deaeration tank 200, over which a stock flow $F_{10}$ flows, from which the air has been removed. This flow $F_{10}$ is passed to the mixing area 60*a* of the wire pit 60. To the mixing area 60*a*, further, a return flow $F_{61}$ from the centrifugal cleaners and the fresh stock flow $M_T$ are passed. From the bottom part of the deaeration tank 200, a stock flow $F_{70}$ is passed to the suction side of a second stock pump 130. This second stock pump 130 feeds the intake stock flow $F_{in}$ through a machine screen 140 into the inlet header of the headbox 150. The bypass flow $F_{out}$ from the headbox inlet header is returned to the bottom part of the deaeration tank 200. The reject $F_{71}$ from the machine screen 140 is passed to reject treatment.

Figure 2:
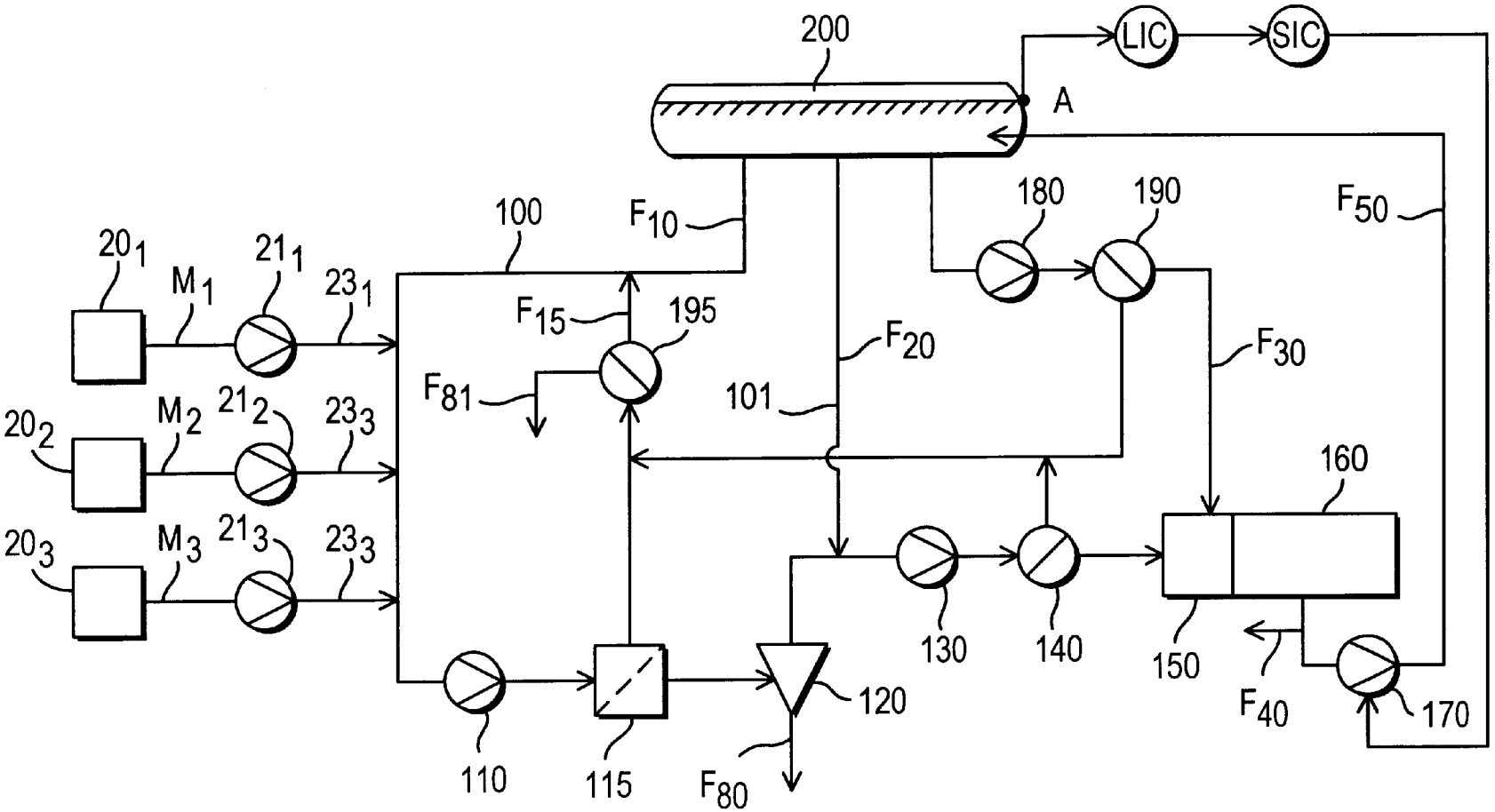
FIG. 2 is a schematic illustration of a process arrangement in accordance with the present invention for the short circulation in a paper machine.

FIG. 2 is a schematic illustration of a process arrangement in accordance with the present invention for the short circulation in a paper machine. Three components stocks $M_1$, $M_2$, $M_3$ are shown, but, from the point of view of the invention, the number of component stocks can be N, wherein N is a positive integer number $\geqq 1$.

In FIG. 2, each component stock $M_i$ is fed from a respective stock chest $\mathbf{20}_i$ by means of a pump $\mathbf{21}_i$ through a component stock feed pipe $\mathbf{23}_i$ into a feed line 100 between the deaeration tank 200 and a first pump 110 in the main line of the process. The first pump 110 in the main line feeds the stock through a screen 115 and through a centrifugal cleaner 120 to the suction side of the second pump 130 in the main line. The second pump 130 in the main line feeds the stock through the machine screen 140 into the headbox 150. The white water $F_{50}$ recovered from the wire section 160 is fed by means of a circulation water pump 170 into the deaeration tank 200. Any excess white water is passed by means of an overflow $F_{40}$ to atmospheric pressure. In the deaeration tank 200, also in this arrangement, there is an air space subjected to a vacuum above the free surface of the stock to thereby cause the removal of air from the white water. In the screen 115, for example, shivers and debris are removed from the stock, and in a centrifugal cleaner 120, for example, sand and other particles heavier than fibers are removed from the stock.

The component stocks $M_i$ are metered from component stock chests $\mathbf{20}_i$ precisely to the mixing volume of the stocks in the dilution water feed pipe 100 coming from the deaeration tank 200. The dilution water feed pipe 100 defines closed space in which the component stocks $M_i$ are mixed and diluted with the flow of dilution water from the deaeration tank 200 (the deaerated white water constituting the dilution water in this case). The precise, substantially constant pressure of the component stock to be metered is produced so that the surface level and the consistency in the component stock chest $\mathbf{20}_i$ are kept substantially constant and so that a substantially constant back pressure is arranged at the mixing point of the component stocks $M_i$. A precise, constant pressure of the mixing volume is produced so that a sufficient reduction in pressure occurs between the nozzle of the component stock $M_1$and the mixing volume, in which case changes of pressure in the mixing volume do not interfere with the metering. The mixing volume is composed of the dilution water feed pipe 100 passing to the first feed pump 110, of the feed pipes $\mathbf{23}_i$ of the metering pumps $\mathbf{21}_i$ and of connection arrangements between them.

The diluting of the stock is carried out in two stages. The dilution of the first stage is carried out at the suction side of the first pump 110 in the main line when the component stocks $M_i$ are fed into the feed line 100 between the deaeration tank 200 and the first pump 110 in the main line. In the deaeration tank 200, the surface level is kept substantially constant by means of a surface level controller of the primary side. The surface level is measured at the point A, and, by means of the surface level controller LIC, the rev. (revolution) controller SIC is controlled, which controls the speed of rotation of the circulation water pump 170. The flow into the feed line 100 takes place with a ram pressure at an constant pressure, in which case the feed pressure of the dilution water flow $F_{10}$ remains constant. This secures a substantially constant back pressure for the component stocks $M_i$ when they are fed into the feed line 100. By means of the first pump 110 in the main line, a substantially constant volume is pumped constantly to stock cleaning 115, 120 and to the dilution of the second stage. In the dilution in the first stage, the stock is diluted to a consistency of about 1.5% in order that the stock could be fed through the screen 115 and through the centrifugal cleaner 120.

The dilution in the second stage is carried out at the suction side of the second feed pump 130 in the main line, to which suction side a second dilution water flow $F_{20}$ of substantially invariable pressure is passed with a ram pressure from the deaeration tank 200. The regulation of the pressure in the headbox 150 controls the speed of rotation of the second feed pump 130 in the main line. In the dilution in the second stage, the stock is diluted to a headbox consistency of about 1%.

Further, a third dilution water flow $F_{30}$ is fed from the deaeration tank 200 to the dilution headbox 150 by means of a dilution water feed pump 180 through a screen 190. By means of this third dilution water flow $F_{30}$ passed into the dilution headbox 150, the stock consistency is profiled in the cross direction of the paper machine.

Figure 3:
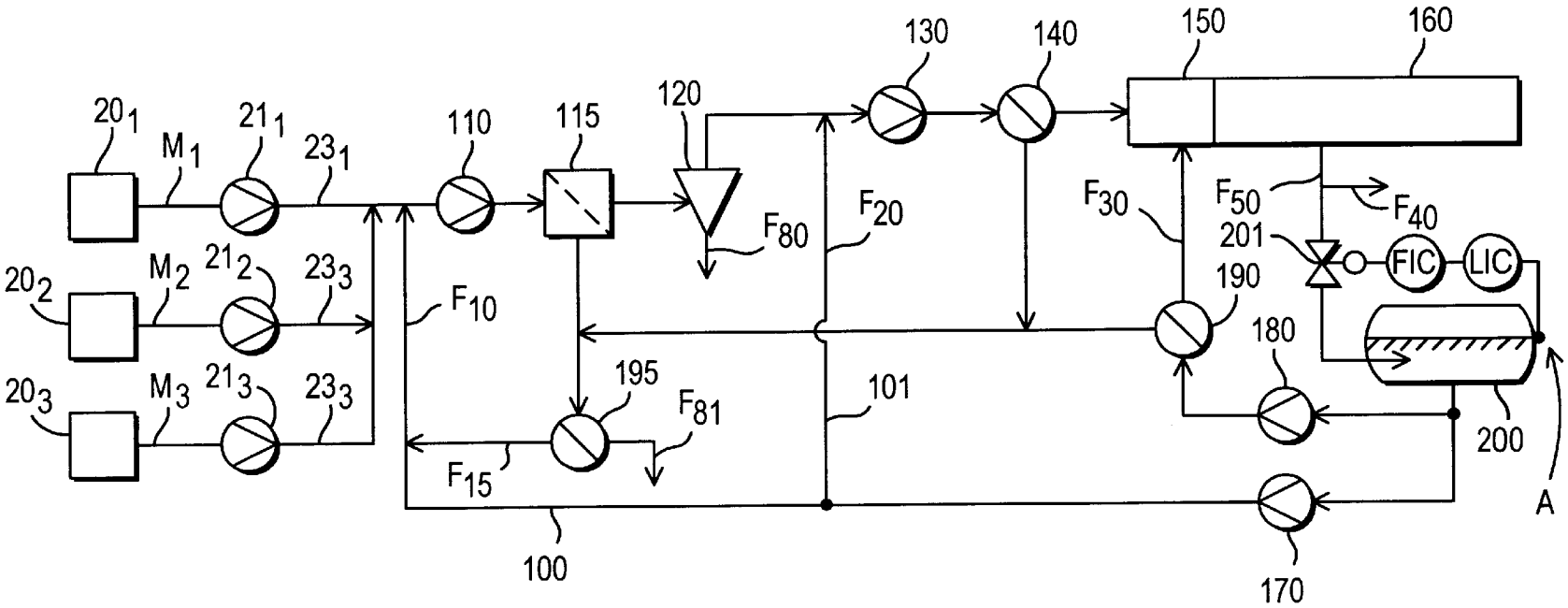
FIG. 3 is a schematic illustration of a modification of the process arrangement shown in FIG. 2 for the short circulation in a paper machine.

FIG. 3 illustrates a modification of the process arrangement shown in FIG. 2, in which modification the deaeration tank 200 is situated below the wire section 160. In such a case, the white water can be passed from the wire section 160 directly by means of ram pressure into the deaeration tank 200, in which there is an air space subjected to a vacuum above the free surface of the stock. From the deaeration tank 200, the dilution water (white water from which air is removed) is fed by means of the circulation water pump 170 into the first $F_{10}$ and second $F_{20}$ dilution stage in the main line of the process. Further, into the dilution headbox 150, a third dilution water flow $F_{30}$ is fed by means of a dilution water feed pump 180 through a screen 190. In the first $F_{10}$ and second $F_{20}$ dilution water flow, a substantially constant pressure can be maintained by means of regulation of the speed of rotation of the circulation water pump 170 and/or by means of throttles in the feed lines 100, 101. Also in this case, there is an overflow $F_{40}$ between the wire section 160 and the deaeration tank 200, from which overflow any excess white water is passed to atmospheric pressure. From the deaeration tank 200, the surface level is measured at the point A, and by means of the surface level controller LIC, the flow controller FIC is controlled, which controls a valve 201 provided in the line passing from the wire section 160 to the deaeration tank 200. In this manner, the surface level in the deaeration tank 200 is kept at a substantially invariable level.

Figure 4:
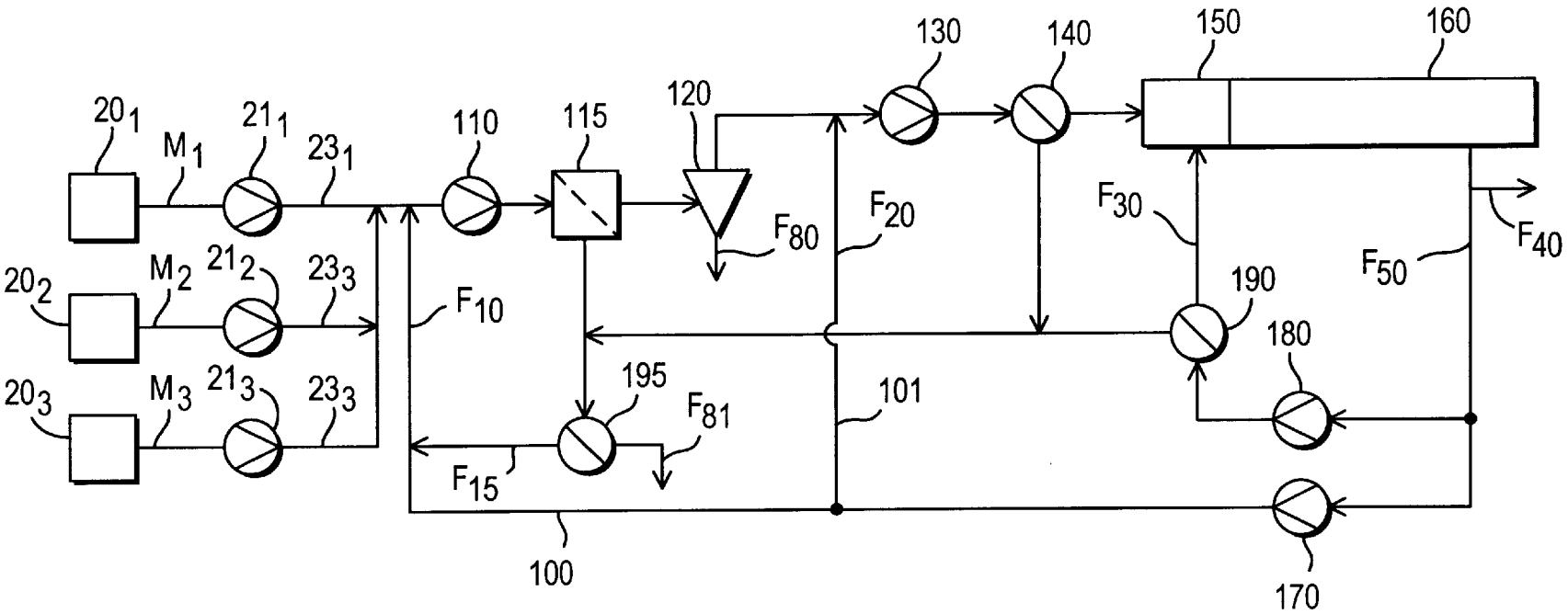
FIG. 4 is a schematic illustration of a second modification of the process arrangement shown in FIG. 2 for the short circulation in a paper machine.

FIG. 4 shows a second modification of the process arrangement shown in FIG. 2, in which modification, the deaeration tank 200 has been removed completely. In such a case, the headbox 150 and the wire section 160 must be closed so that the stock does not come into contact with the surrounding air. The white water collected from the closed wire section 160 is then fed directly, by means of the circulation water pump 170, into the first $F_{10}$ and second $F_{20}$ dilution stage in the main line of the process. In this embodiment, the process is closed in relation to the surrounding air. Thus, only the overflow $F_{40}$ of the white water, the reject $F_{80}$ from the centrifugal cleaner 120, and the reject $F_{81}$ from the second screen 195 communicate with the surrounding air.

Figure 5:
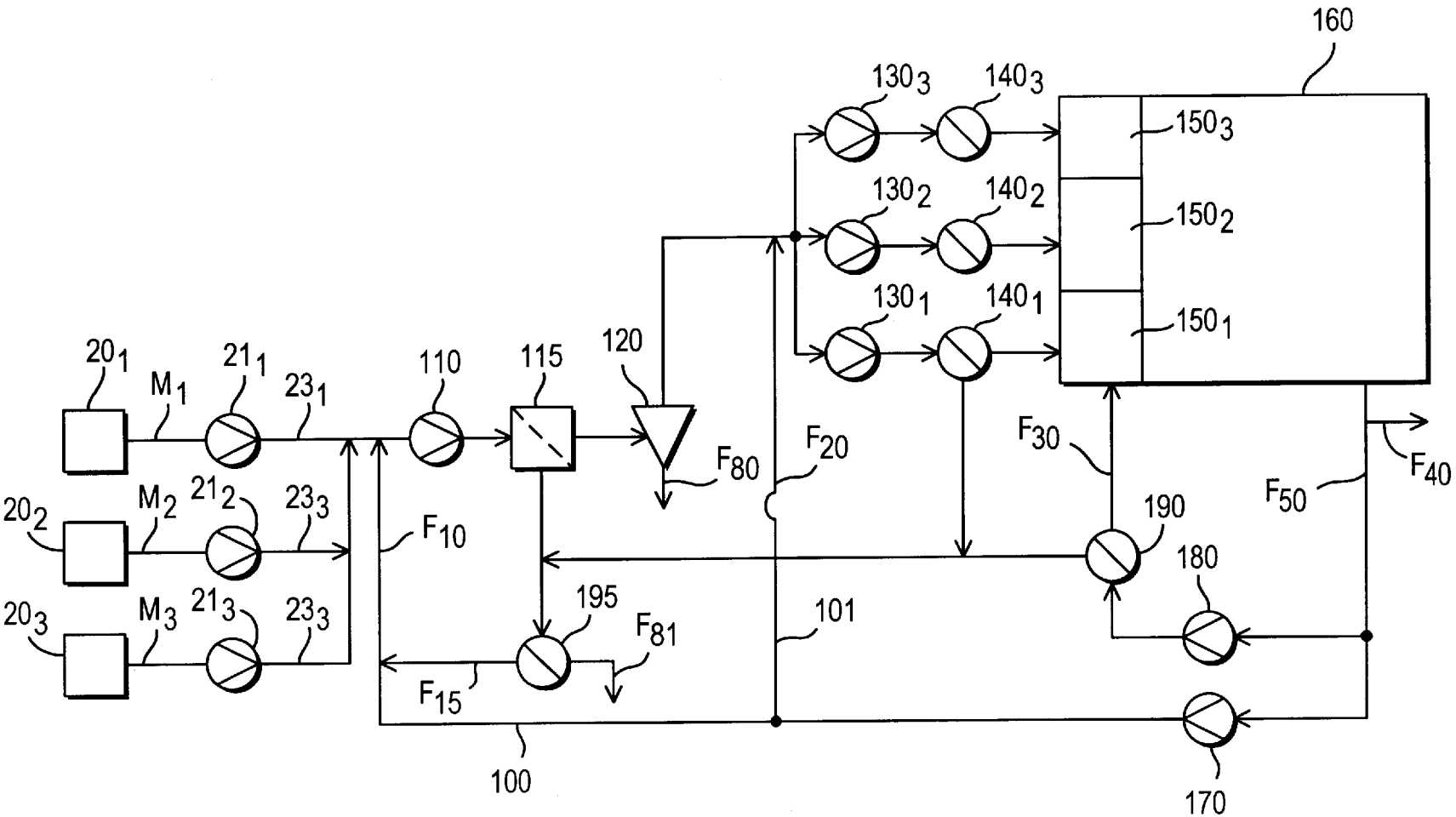
FIG. 5 shows a modification of the process arrangement shown in FIG. 4 for the short circulation in a paper machine.

FIG. 5 shows a modification of the process arrangement shown in FIG. 4 for use in connection with a headbox having a plurality of inlet headers. In this embodiment, application of fillers and admixtures in layers in a three-layer headbox is used. The main line of the process is divided into three branches after the centrifugal cleaning device 120. In each branch, there is a feed pump $\mathbf{130}_1, \ldots, \mathbf{130}_3$, by whose means the stock fed is fed through the machine screen $\mathbf{140}_1, \ldots, \mathbf{140}_3$ of each branch into each portion or inlet header $\mathbf{150}_1, \ldots, \mathbf{150}_3$ in the headbox. The middle portion $\mathbf{150}_2$ of the three-layer headbox forms the middle layer in the web, and the first $\mathbf{150}_1$ and the third $\mathbf{150}_3$ part of the headbox form the surface layers in the web. Into each branch, to the suction side of the feed pumps $\mathbf{130}_1, \ldots, \mathbf{130}_3$, it is possible to feed starch, fillers and retention agents in the desired proportions. Further, retention agents can be fed into each branch in the desired proportion between the machine screens $\mathbf{140}_1, \ldots, \mathbf{140}_3$ and the headbox $\mathbf{150}_1, \ldots, \mathbf{150}_3$. In addition to dilution water, starch and fillers can also be fed into the closed mixing volume preceding the first feed pump 110. The component stocks $M_1, \ldots, M_3$ can be, in fine paper, pulp of long fibers, pulp of short fibers and broke, and, in SC paper, mechanical pulp, chemical pulp and broke.

Figure 6:
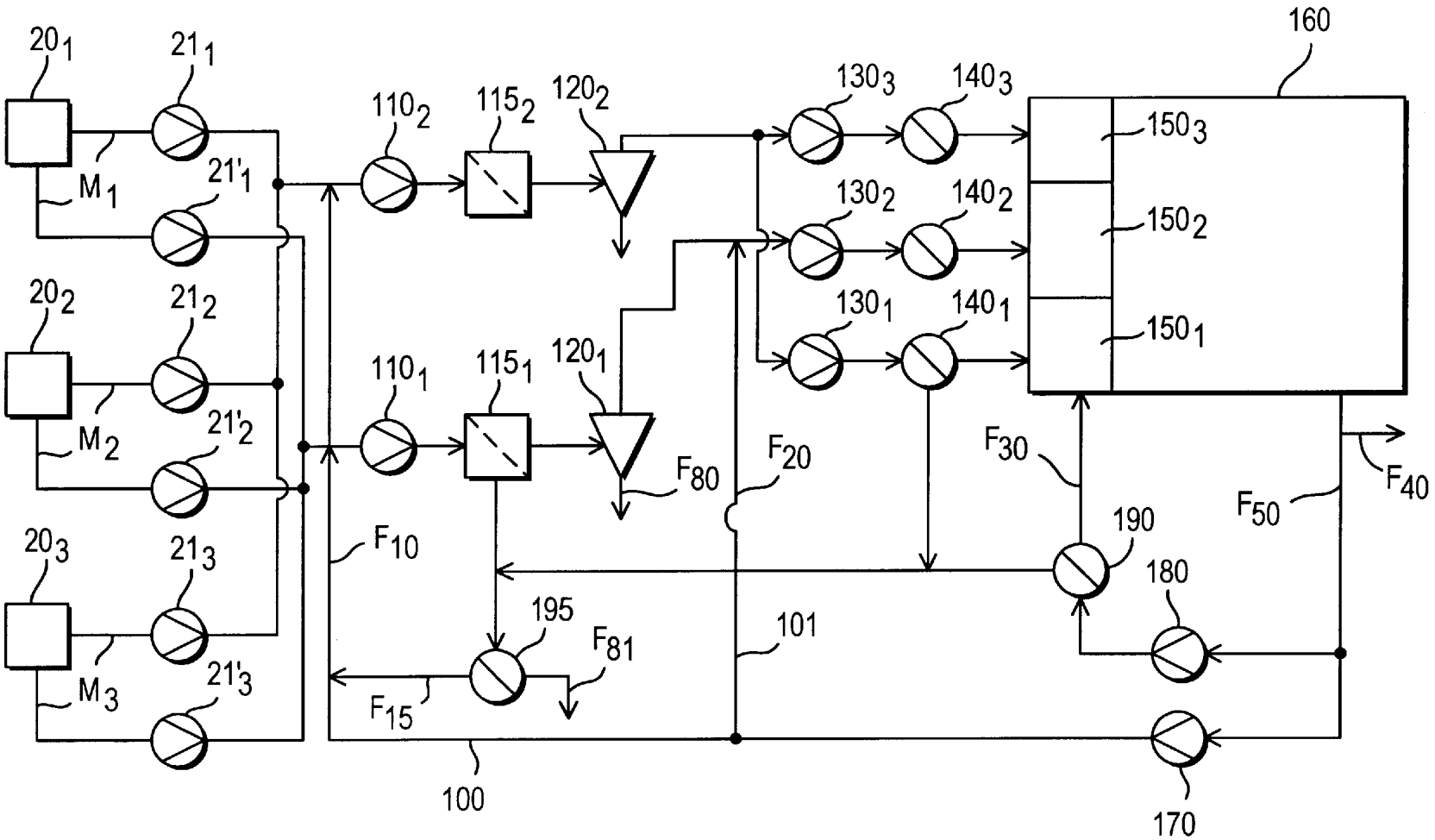
FIG. 6 shows a second modification of the process arrangement shown in FIG. 4 for the short circulation in a paper machine.

FIG. 6 shows a second modification of the process arrangement shown in FIG. 4 for use in connection with a headbox having a plurality of inlet headers. In this embodiment, besides application of fillers and admixtures in layers, application of fibers in layers is also used. Two separate main lines are used, into which component stocks $M_1, \ldots, M_3$ can be metered from component stock chests in the desired proportion. The main line placed at the bottom in FIG. 6 corresponds to the main line in FIG. 4, and by means of this first main line, stock is fed into the middle portion $\mathbf{150}_2$ of the headbox which forms the middle layer in the web. The second main line is divided into two branches after the centrifugal cleaner $\mathbf{120}_2$, by means of which branches stock is fed into the first $\mathbf{150}_1$ and the third part $\mathbf{150}_3$ in the headbox, which parts form the surface layers in the web. The first $F_{10}$ and the second $F_{20}$ dilution water flows are passed into both of the main lines. To the suction side of the feed pumps $\mathbf{130}_1, \ldots, \mathbf{130}_3$ of the branches of the headbox, starch, fillers and retention agents can be fed in the desired proportions. Further, retention agents can be fed into each branch in the desired proportion between the machine screens $\mathbf{140}_1, \ldots, \mathbf{140}_3$ and the headbox $\mathbf{150}_1, \ldots, \mathbf{150}_3$. In addition to dilution water, starch and fillers can also be fed into the closed mixing volume which precedes the first feed pumps $\mathbf{110}_1$, $\mathbf{110}_2$ in the main lines.

When manufacturing fine paper, instead of the three component stocks $M_1, \ldots, M_3$ illustrated in FIG. 6, it is possible to use four component stocks, which are pulp of long fibers, first pulp of short fibers, second pulp of short fibers, and broke. Also, the broke may be divided into broke of long fibers and broke of short fibers, in which case five component stocks are used. Thus, component stocks can be metered in the desired proportions into the middle layer in the web and into the surface layers in the web.

The arrangements shown in FIGS. 5 and 6 are, of course, not restricted to a three-layer headbox, but the principles described in them can also be applied to a two-layer headbox or to a headbox consisting of more than three layers.

The arrangements illustrated in FIGS. 5 and 6 can, of course, also be employed in connection with the embodiments illustrated in FIGS. 2–4.

In the embodiments shown in FIGS. 2–6, the rejects from the first screen 115 or screens $\mathbf{115}_1$, $\mathbf{115}_2$, from the machine screen 140 or machine screens $\mathbf{140}_1, \ldots, \mathbf{140}_3$, and from the dilution water screen 190 of the headbox are passed into a second screen 195, whose accept $F_{15}$ is fed into the first dilution water line 100. The reject $F_{80}$ from the centrifugal cleaner 120 or centrifugal cleaners $\mathbf{120}_1$, $\mathbf{120}_2$ and the reject $F_{81}$ from the second screen 195 are removed from the process.

In FIG. 2, the feed pipes $\mathbf{23}_i$ of the component stocks $M_i$ have been passed directly to the dilution water feed pipe 100. In FIGS. 3–6, the component stock feed pipes 23, have been passed first into a common pipe, which common pipe has then been passed to the dilution water feed pipe 100. From the point of view of the present invention, the coupling between the component stock $M_i$ feed pipes $\mathbf{23}_i$and the first dilution water feed pipe 100 can be of any kind whatsoever, provided that the mixing together of the component stocks and the mixing of the component stocks with the dilution water can be made efficient.

In FIGS. 2–6, no bypass flow of stock or dilution water at the inlet header of the headbox 150 has been illustrated. These bypass flows are arranged here by means of short feed-back connections.

FIGS. 2–6 illustrate arrangements in which a dilution headbox is employed, but the invention can also be applied in connection with a headbox of a different sort. In such a case, a second circulation water pump 180 and a related screen 190 are not needed at all.

In the arrangements shown in FIGS. 2–6, white water is used in the main line of the process at the suction sides of both of the main line feed pumps 110, 130 for dilution of the stock, and in the dilution headbox 150 for profiling of the basis weight. In addition to this, white water can be used in earlier stages of the process for dilution of stocks.

The main line screen 115 or screens $\mathbf{115}_1$, $\mathbf{115}_2$ and the centrifugal cleaner 120 or centrifugal cleaners $\mathbf{120}_1$, $\mathbf{120}_2$ shown in FIGS. 2–6 can comprise one or more stages.

The first feed pump 110 or feed pumps $\mathbf{110}_1$, $\mathbf{110}_2$, the screen 115 or screens $\mathbf{115}_1$, $\mathbf{115}_2$, the machine screen 140 or machine screens $\mathbf{140}_1$, $\mathbf{140}_2$, and the centrifugal cleaner 120 or centrifugal cleaners $\mathbf{120}_1$, $\mathbf{120}_2$ shown in the main line in FIGS. 2–6 can be omitted completely in a situation in which the component stocks $M_i$ have already been cleaned to a sufficiently high level of purity before the stock chests $\mathbf{20}_i$. In such a case, in the main line of the process, just the feed pump 130 or feed pumps $\mathbf{130}_1, \ldots, \mathbf{130}_3$ is/are needed.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A process arrangement for the short circulation in a paper or board machine including a headbox having at least one inlet header and a wire section, comprising a plurality of stock chests, each receiving a component stock, means defining a closed space for receiving each of the component stocks and mixing the same, metering pumps, each associated with a respective one of said stock chests for pumping the component stock from said respective stock chest into said closed space, dilution water being directed into said closed space whereby the component stocks and dilution water are mixed in said closed space, and at least one feed pump for pumping the mixed component stocks and dilution water through an enclosed environment from said closed space into a respective one of the at least one inlet header of the headbox.

2. The process arrangement of claim 1, wherein the at least one inlet header comprises a plurality of inlet headers and said at least one feed pump comprises a plurality of feed pumps, each of said feed pumps being arranged to pump at least a portion of the mixed component stocks and first flow of dilution water from said closed space into a respective one of the inlet headers.

3. The process arrangement of claim 1, wherein said means defining said closed space comprise a main flow line.

4. The process arrangement of claim 1, wherein the paper or board machine includes a wire section and white water is recovered from the wire section, further comprising a deaeration tank for receiving white water recovered from the wire section, said deaeration tank being situated in an upper position relative to said closed space such that white water is passed from said deaeration tank by means of ram pressure into said closed space to thereby constitute the dilution water, said deaeration tank being structured and arranged such that tank air is removed from the white water by means of a vacuum.

5. The process arrangement of claim 1, wherein the paper or board machine includes a wire section and white water is recovered from the wire section, the white water constituting dilution water, further comprising a dilution water pump for pumping white water recovered from the wire section into the at least one inlet header of the headbox, and a dilution water screen interposed between said dilution water pump and the at least one inlet header of the headbox for screening the white water.

6. A process arrangement for the short circulation in a paper or board machine including a headbox having at least one inlet header, comprising a plurality of stock chests, each receiving a component stock, means defining a closed space, metering pumps, each associated with a respective one of said stock chests for pumping the component stock from said respective stock chest into said closed space, a first flow of dilution water being directed into said closed space whereby the component stocks and the first flow of dilution water are mixed in said closed space, cleaning means for cleaning stock, a first feed pump in flow communication with said closed space, at least one second feed pump, said first feed pump being arranged to direct the mixed component stocks and first flow of dilution water from said closed space through said cleaning means to each of said at least one second feed pump, a second flow of dilution water being directed into the mixed component stocks and first flow of dilution water after said cleaning means and before said at least one second feed pump, and at least one machine screen, each of said at least one machine screen being interposed between a respective one of said at least one second feed pump and a respective one of the at least one inlet header, each of said at least one second feed pump being arranged to direct the mixed component stocks and the first and second flows of dilution water though a respective one of said at least one machine screen into the respective one of the at least one inlet header of the headbox.

7. The process arrangement of claim 6, wherein said means defining said closed space comprise a main flow line.

8. The process arrangement of claim 6, wherein the paper or board machine includes a wire section and white water is recovered from the wire section, the white water constituting the dilution water, further comprising a deaeration tank for receiving white water recovered from the wire section, said deaeration tank being situated in an upper position relative to said closed space such that white water is passed from said deaeration tank by means of ram pressure into said closed space to thereby constitute the first flow of dilution water and white water is passed from said deaeration tank by means of ram pressure into the mixed component stocks and first flow of dilution water after said cleaning means and before said at least one second feed pump to thereby constitute the second flow of dilution water, said deaeration tank being structured and arranged such that tank air is removed from the white water by means of a vacuum.

9. The process arrangement of claim 6, wherein the paper or board machine includes a wire section and white water is recovered from the wire section, the white water constituting dilution water, further comprising a dilution water pump for pumping white water recovered from the wire section into the at least one inlet header of the headbox, and a dilution water screen interposed between said dilution water pump and the at least one inlet header of the headbox for screening the white water.

10. The process arrangement of claim 6, wherein said cleaning means comprise a screening device and a centrifugal cleaning device.

11. A process arrangement for the short circulation in a paper or board machine including a headbox having at least one inlet header and a wire section, comprising a plurality of stock chests, each receiving a component stock, means defining a closed space for receiving each of the component stocks and mixing the same, metering pumps, each associated with a respective one of said stock chests for pumping the component stock from said respective stock chest into said closed space, means for collecting dilution water from said wire section and means for passing said dilution water to a deaeration tank for deaerating said dilution water to obtain deaerated dilution water flow said deaerated dilution water being directed into said closed space whereby the component stocks and said deaerated dilution water are mixed in said closed space, and at least one feed pump for pumping the mixed component stocks and deaerated dilution water through an enclosed environment from said closed space into a respective one of the at least one inlet header of the headbox.

12. The process arrangement of claim 1, wherein the paper or board machine includes a wire section and white water is recovered from the wire section, further comprising:

a deaeration tank situated in a lower position relative to the wire section such that white water recovered from the wire section is passed by means of ram pressure into said deaeration tank, said deaeration tank being structured and arranged such that tank air is removed from the white water by means of a vacuum, and a circulation water pump for pumping white water from said deaeration tank into said closed space which thereby constitutes the dilution water.

13. The process arrangement of claim 1, wherein the paper or board machine includes a wire section and white water is recovered from the wire section, further comprising:

a circulation water pump for pumping white water recovered from the wire section directly from the wire section and pumping the white water into said closed space which thereby constitutes the dilution water.

14. The process arrangement of claim 6, wherein said at least on second feed pump comprises a plurality of second feed pumps, said at least one machine screen comprises a plurality of machine screens and the at least one inlet header comprises a plurality of inlet headers.

15. The process arrangement of claim 6, wherein the paper or board machine includes a wire section and white water is recovered from the wire section, the white water constituting the dilution water, further comprising:

a deaeration tank situated in a lower position relative to the wire section such that white water recovered from the wire section is passed by means of ram pressure into said deaeration tank, said deaeration tank being structured and arranged such that tank air is removed from the white water by means of vacuum, and a circulation water pump for pumping white water from said deaeration tank into said closed space which thereby constitutes the first flow of dilution water and pumping white water from said deaeration tank into the mixed component stocks and first flow of dilution water after said cleaning means and before said at least one second feed pump which thereby constitutes the second flow of dilution water.

16. The process arrangement of claim 6, wherein the paper or board machine includes a wire section and white water is recovered from the wire section, the white water constituting the dilution water, further comprising:

a circulation water pump for receiving white water recovered from the wire section directly from the wire section and pumping white water into said closed space which thereby constitutes the first flow of dilution water and pumping white water into the mixed component stocks and first flow of dilution water after said cleaning means and before said at least one second feed pump which thereby constitutes the second flow of dilution water.

17. A process arrangement for the short circulation in a paper or board machine including a headbox having a plurality of inlet headers, comprising:

a plurality of stock chests, each receiving a component stock, means defining a plurality of separate closed spaces, metering pumps associated with said stock chests for pumping component stocks from said stock chests in a desired proportion into said closed spaces, a first flow of dilution water being directed into each of said closed spaces whereby the component stocks and first flows of dilution water through an enclosed environment from a respective one of said closed spaces to a respective one of the inlet headers of the headbox.

18. The process arrangement of claim 17, further comprising:

a plurality of cleaning means, each for cleaning a respective one of the component stocks and first flow of dilution water, and second feed pumps, each of said second feed pumps being arranged to pump the mixed component stocks and first flow of dilution water from a respective one of said closed spaces through a respective one of said cleaning means to at least one of said first feed pumps.

19. The process arrangement of claim 18, wherein one of said second feed pumps is arranged to pump the mixed component stocks and first flow of dilution water from a respective one of said closed spaces through a respective one of said cleaning means to a plurality of said first feed pumps.

20. The process arrangement of claim 18, wherein each of said cleaning means comprises a screen device and a centrifugal cleaning device.

21. The process arrangement of claim 18, further comprising:

means for directing a second flow of dilution water into each of the mixed component stocks and first flow of dilution water after said cleaning means and before said first feed pumps.

22. The process arrangement of claim 21, wherein the paper or board machine includes a wire section and white water is recovered from the wire section, the white water constituting the dilution water, further comprising:

a deaeration tank for receiving white water recovered from the wire section, said desertion tank being situated in an upper position relative to said closed spaces such that white water is passed from said deaeration tank by means of ram pressure into said closed spaces to thereby constitute the first flows of dilution water and white water is passed from said deaeration tank by means of ram pressure into the mixed component stocks and first flows of dilution water after said cleaning means and before said first feed pumps to thereby constitute the second flows of dilution water, said deaeration tank being structured and arranged such that tank air is removed from the white water by means of a vacuum.

23. The process arrangement of claim 21, wherein the paper or board machine includes a wire section and white water is recovered from the wire section, the white water constituting the dilution water, further comprising:

a deaeration tank situated in a lower position relative to the wire section such that white water recovered from the wire section is passed by means of ram pressure into said deaeration tank, said deaeration tank being structured and arranged such that tank air is removed from the white water by means of a vacuum, and a circulation water pump for pumping white water from said deaeration tank into said closed spaces which thereby constitutes the first flows of dilution water and pumping white water from said deaeration tank into the mixed component stocks and first flows of dilution water after said cleaning means and before said at least one second feed pump which thereby constitutes the second flows of dilution water.

24. The process arrangement of claim 21, wherein the paper or board machine includes a wire section and white water is recovered from the wire section, the white water constituting the dilution water, further comprising:

a circulation water pump for receiving white water recovered from the wire section directly from the wire section and pumping white water into said closed spaces which thereby constitutes the first flows of dilution water pumping white water into the mixed component stocks and first flows of dilution water after said cleaning means and before said first feed pumps which thereby constitutes the second flows of dilution water.

25. The process arrangement of claim 17, wherein the paper or board machine includes a wire section and white water is recovered from the wire section, the white water constituting the dilution water, further comprising:

a deaeration tank for receiving white water recovered from the wire section, said deaeration tank being situated in an upper position relative to said closed spaces such that white water is passed from said deaeration tank by means of ram pressure into said closed spaces to thereby constitute the first flows of dilution water, said deaeration tank being structured and arranged such that tank air is removed from the white water by means of a vacuum.

26. The process arrangement of claim 17, wherein the paper or board machine includes a wire section and white water is recovered from the wire section, the white water constituting the dilution water, further comprising:

a deaeration tank situated in a lower position relative to the wire section such that white water recovered from the wire section is passed by means of ram pressure into said deaeration tank, said deaeration tank being structured and arranged such that tank air is removed from the white water by means of a vacuum, and a circulation water pump for pumping white water from said deaeration tank into each of said closed spaces which thereby constitutes the first flows of dilution water.

27. The process arrangement of claim 17, wherein the paper or board machine includes a wire section and white water is recovered from the wire section, the white water constituting the dilution water, further comprising:

a circulation water pump for receiving white water recovered from the wire section directly from the wire section and pumping the white water to said first feed pumps.

28. The process arrangement of claim 17, wherein the paper or board machine includes a wire section and white water is recovered from the wire section, the white water constituting dilution water, further comprising:

a dilution water pump for pumping white water recovered from the wire section into the inlet headers of the headbox, and a dilution water screen interposed between said dilution water pump and each of the inlet headers of the headbox for screening the white water.

29. The process arrangement of claim 17, wherein said means defining said closed spaces comprise a plurality of main flow lines.

30. The process arrangement of claim 17, wherein said means defining said closed spaces define only two closed spaces.

31. The process arrangement of claim 30, wherein said metering pumps comprise two metering pumps associated with each of said stock chests and arranged such that each of said closed spaces is receivable of component stock from each of said stock chests.

* * * * *